United States Patent [19]

Roberts

[11] 4,111,414

[45] Sep. 5, 1978

[54] EXERCISING DEVICE FOR ASSISTING A PERSON TO PERFORM PULLUPS

[76] Inventor: Edward A. Roberts, 2205 Bahia Dr., La Jolla, Calif. 92037

[21] Appl. No.: 726,881

[22] Filed: Oct. 12, 1976

[51] Int. Cl.[2] ..... A63B 1/00

[52] U.S. Cl. ..... 272/62; 272/118

[58] Field of Search ..... 272/120, 119, 121, 136, 272/118, 117, 139, 142, 144, 143, 125, DIG. 4; 128/25 R, 75

[56] References Cited

U.S. PATENT DOCUMENTS

| | | | |
|---|---|---|---|
| 3,033,198 | 5/1962 | Jensen | 272/117 X |
| 3,301,552 | 1/1967 | Ryan | 272/117 |
| 3,708,167 | 1/1973 | Potgieter | 272/125 X |
| 3,752,473 | 8/1973 | LaLanne | 272/118 X |
| 3,834,694 | 9/1974 | Pridgen | 272/118 |
| 3,861,675 | 1/1975 | Hopper | 272/117 X |

FOREIGN PATENT DOCUMENTS

| | | | |
|---|---|---|---|
| 1,075,797 | 2/1960 | Fed. Rep. of Germany | 128/25 R |

*Primary Examiner*—William R. Browne
*Attorney, Agent, or Firm*—Frank D. Gilliam

[57] ABSTRACT

A pullup assisting device that is wall attached by support brackets for supporting the weight of a person and the device, a bar is held between the support brackets for grasping by the user, a harness positioned at one end of a cable for supporting the user, the cable passes over a pully rotatably held between the support brackets, the opposite end of the cable is attached to weights selected for effectively cancelling at least a portion of the weight of the user.

6 Claims, 2 Drawing Figures

12
14
18
10
36
20
32
34
14
16
38
20
32
30
16
18
40
22
44
42
28
28
29
29
26

12
36
14
34
30
18
20
16
38
22
28
40
44
28
29
26

EXERCISING DEVICE FOR ASSISTING A PERSON TO PERFORM PULLUPS

BACKGROUND OF THE INVENTION

The present invention relates to a body exercising machine and more particularly to a device for training a person to perform pullups.

The prior art means for developing the strength of a person to perform pullups when that person did not have the necessary strength, was to put the person on a weight lifting schedule. As the strength of the person is increased, due to lifting weights, then pullups may again be attempted. This continued until the person could perform at least one pullup. The person then further develops by continuing to do pullups.

This means is both awkward and slow in developing pullup skills.

SUMMARY OF THE INVENTION

The present invention provides a means for a person to build up strength to perform pullups by starting right out in a pullup environment by effectively reducing his weight by counter balance means so that once a sufficient amount of his weight is offset, the person could start right out performing pullups. As the person's skills and strength are developed, a portion of the counter weight is removed until the person can successfully lift his own weight. It has been found that a person begins to develop the ability to perform pullups against his own weight sooner by this method than by the prior art weight lifting method.

The main object of this invention is to provide a means for developing a person to perform pullups by cancelling a portion of a person's body weight and then gradually decreasing the reduced body weight until the person can lift his own weight sucessfully.

Another object of this invention is to provide an inexpensive machine that is simple to construct and operate, that improves the pullup capability of a user of the device.

A further object of this invention is to provide a pullup training device that employs a pullup environment from the beginning of the training.

The foregoing objects, features, advantages and results of the present invention, together with various other objects, advantages, features and results thereof which will be evident to those skilled in the body exercising art in the light of the disclosure, may be achieved with the exemplary embodiment of the invention illustrated in detail hereinafter.

DESCRIPTION OF THE PREFERRED EMBODIMENT

Figure 1:
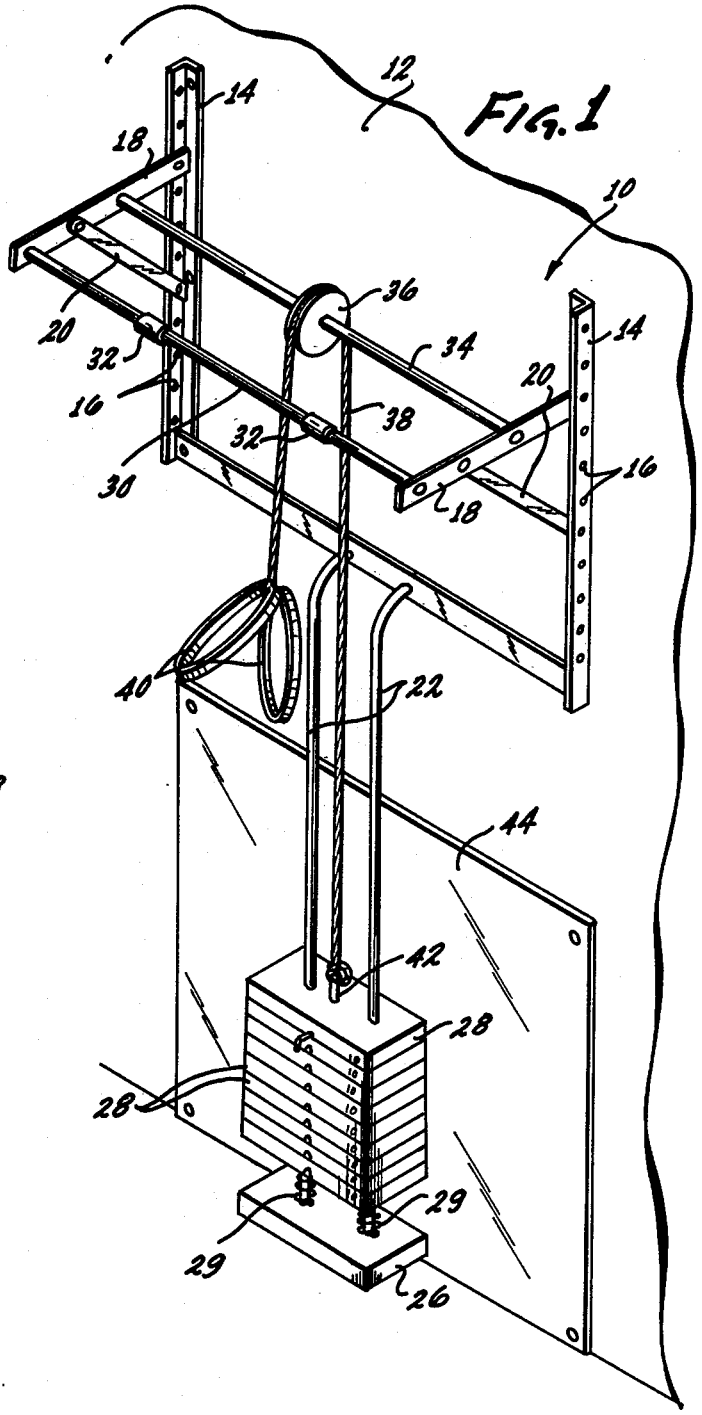
FIG. 1 is a perspective view of the pullup device which incorporates the invention.
Figure 2:
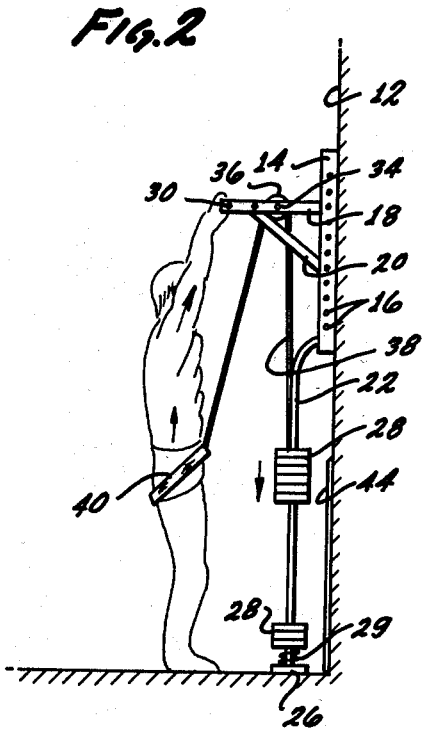
FIG. 2 is a side view of the device of FIG. 1 showing a person in position for using the device.

Referring now to the Figures, the pullup assist device 10 is attached to a vertical wall 12 by any convenient means, such as, but not limited to, lag bolts and the like not shown.

The frame members 14 are constructed of angle iron or the like formed in the shape of an "L". One side of the "L" is attached to wall 12 in the manner discussed. A plurality of spaced apart holes 16 are positioned along the other side of the "L". These holes 16 are used to secure one end of the arms 18 and one end of braces 20. The other end of braces 20 being secured to arms 18 intermediate their ends. These various connections are made with nut and bolt combinations or quick disconnect pin arrangements or the like for easy repositioning of the arms 18. The height depending on the height of the person utilizing the device.

Attached to the wall or attached in combination to the wall and frame are weight guides 22. The tubular weight guides 22 are attached at one end to the support means 24 between the frame members 14 and are supported at their other ends to a floor plate or buffer 26 which is constructed of resilient material, such as, but not limited to, rubber or the like.

Slidably positioned on the weight guides 22 are a plurality of calibrated weights 28. The bottom weight is spaced from the floor plate 26 by buffer springs 29 formed around the tubular members. These springs act as cushions in the event that one or more of the weights 28 are inadvertently dropped.

Positioned between arms 18, at their outer ends, is a pullup bar 30. Positioned inward from the ends of the pullup bar 30 are two adjacent anti-slip grip means 32 positioned to be conveniently gripped by a person utilizing the device. Positioned between arms 18, intermediate brackets 20 and frame members 14, is a rod 34 with a pully 36 rotatably engaged therewith positioned at the approximate center thereof.

A cable 38 is passed over the pully 36. One end of which includes a pair of loops 40. The opposite end of the cable is attached to a bar 42 that passes down through the center of the plurality of weights 28. The weights are confined by the weight guides 22 and are selectively, releasably engaged to the bar 42 by any convenient means so as to vary the total weight attached to the bar. An example of their confinement and selectivity is taught by U.S. Pat. No. 3,912,263 by Stephen John Yatso. The device is not limited to this teaching.

A kick plate 44 attached to the wall 12 may be utilized to protect the wall from damage that might occur by use of the device.

OPERATION OF THE PREFERRED EMBODIMENT

A person utilizing the device for developing pullup skills inserts his legs through the loops 40. The number of weights 28 required to counter balance about one half of the users weight is attached to bar 42. The lower weight of the stack not required for this particular person remain disengaged.

The person now grasps the pullup bar 32 and pulls himself upward by the strength of his arms.

As the person builds up his strength by continued use of the device, more weights are disengaged from bar 42 until the user can lift his own weight and perform pullups without assistance.

The invention may be embodied in other specific forms without departing from the spirit or essential characteristics thereof. The present embodiment is, therefore, to be considered in all aspects as illustrative and not restrictive, the scope of the invention being indicated by the appended claims rather than by the foregoing description, and all changes which come within the meaning and range of equivalency of the claims are therefore intended to be embraced therein.

What is claimed as new and useful and desired to be secured by U.S. letters patent is:

1. A pullup assist device for a person performing pullups comprising:

a support structure for supporting the weight of said device and said person;

a bar means carried by said support structure, adapted for use by a for said person to grasp and pull up against to perform said pullups while being assisted by the gravitational attraction of a counter weight, said bar means being selectively positioned vertically above the head of a person at a height dependent upon the height and reach of a person using the device;

a flexible means for aiding in lifting during a pullup exercise person; and means attached to and cooperating with said flexible means for aiding in lifting a person cancelling a selected portion of the weight of said person when performing a pullups.

2. The invention as defined in claim 1, wherein said support structure comprises a frame having a pair of spaced apart wall mounted brackets with vertically adjustable arms extending away from said wall for supporting said bar means therebetween.

3. The invention as defined in claim 2, wherein said bar means has two spaced apart anti-slip gripping members attached thereto.

4. The invention as defined in claim 1, wherein said means for supporting the weight of said person comprises a cable with a harness member at one end thereof, said harness having two loops for a person to insert his legs therethrough, the opposite end of said cable attached to said means attached to and cooperating with said flexible means said cable between said harness and said counter balancing means passing over a pully rotatably attached to a rod member, said rod member being attached to said support member and positioned adjacent said bar means.

5. The invention as defined in claim 4, wherein said means attached to and cooperating with said flexible means comprises a plurality of individual weights releasably connected to said cable.

6. The invention as defined in claim 1, wherein said means attached to and cooperating with said flexible means comprises a plurality of individual weights of a pre-selected value releasably attached to said cable.

* * * * *